United States Patent [19]

Singer

[11] 4,291,763

[45] Sep. 29, 1981

[54] DISPENSER FOR OIL WELL TREATING CHEMICALS

[76] Inventor: Mortimer Singer, 2320 Plaza del Grande, Las Vegas, Nev. 89102

[21] Appl. No.: 91,468

[22] Filed: Nov. 5, 1979

[51] Int. Cl.[3] ..... E21B 21/00; E21B 43/12

[52] U.S. Cl. ..... 166/110; 166/169

[58] Field of Search ..... 166/69, 105, 107, 110, 166/162, 169

[56] References Cited

U.S. PATENT DOCUMENTS

| | | | |
|---|---|---|---|
| 337,496 | 3/1986 | Hodson | 166/105 |
| 642,012 | 1/1900 | Sham | 166/110 |
| 1,389,007 | 8/1921 | Norbye | 166/105 X |
| 2,859,827 | 11/1958 | Eklins et al. | 166/69 X |
| 2,891,622 | 6/1959 | Patterson et al. | 166/105 X |
| 3,187,567 | 6/1965 | O'Brien et al. | 166/169 X |
| 4,119,150 | 10/1978 | Froelich | 166/69 X |

*Primary Examiner*—James A. Leppink
*Assistant Examiner*—George A. Suchfield
*Attorney, Agent, or Firm*—Daniel Silverman

[57] ABSTRACT

A dispenser for well treating chemicals for pumping oil wells, for attachment to the bottom end of the tubing string, comprises a long cylindrical container, closed at top and bottom, about the same diameter as the tubing and rigidly attachable to the bottom end of the tubing. The bottom end of the chamber is preferably pointed, with at least one opening in the bottom end. The chamber is filled with chunks of solid chemical, of a nature normally used for treating wells. In the normal pumping action, the weight of the well fluid filling the tubing to the surface is supported by the sucker rods during that part of the pumping cycle when the rods are moving up. When the rods are moving down, the weight is carried by the tubing. This varying load on the tubing causes it to lengthen under load, and shorten, so that the bottom end of the tubing raises and lowers through a range of a foot or more. This sloshing of the tubing up and down in the well fluid (and the dispenser with it) causes water to be alternately injected into and withdrawn from the bottom openings, and thus dissolving chemical as it moves in and out.

10 Claims, 3 Drawing Figures

DISPENSER FOR OIL WELL TREATING CHEMICALS

BACKGROUND OF THE INVENTION

1. Field of the Invention

This invention lies in the field of producing oil wells. More particularly, it concerns wells of a pumping status of which the greatest majority are wells producing oil and water. In the minority of the cases, those that produce very little or no water have paraffin problems. The chemicals that can be used in this patent can correct the paraffin problem.

The great majority of oil wells carry a certain percentage of water with the oil, in which are minerals and/or chemicals that precipitate from solution as the water flows into the well, either through perforations, or in open formation completions. This forms a scale of gypsum, barium, and/or other minerals that clog porosity, restricting the flow of oil into the borehole. These precipitates also affect pumping equipment by their coatings, causing standing valves and pump barrels to pit, wear, and lose efficiency.

This also requires expensive well servicing operations to pull all pumping equipment out of the well and to inject well treating chemicals into the well to remove these deposits. There are many commercial chemicals that can dissolve this material, but the big problem is to position these chemicals directly on the bottom of the hole, at the producing formation, so that the formation wall and pores can be cleaned.

The crux of the problem is to provide the treating on a continuous basis, at a rate proportional to the influx of water and contamination it carries, and to position the chemicals at the bottom of the hole to treat the water as it flows in, and also to treat the interior of the pump and tubing as the oil and water are pumped out.

2. Description of the Prior Art

In the prior art there have been many types of apparatus and procedures designed to place chemicals of of selected composition in position on the well bottom. None of these devices have eliminated the need for expensive work-overs. The fact is that gypsum and other contaminating precipitates remain a constant problem in oil production.

Some of these processes provide for dripping or pouring a liquid chemical solution, at selected intervals, down the annulus of the well. It is doubtful whether these solutions ever do any more than coat the casing and tubing. In any event they can, at best, only reach the perforated nipple at the pump inlet, and be pumped back to surface. Certainly they cannot reach a level below the fluid level standing in the casing, usually far above the intended treating zone, the producing zone.

This invention describes an apparatus for providing a supply of chemical on bottom, and metering it out as a function of the rate of flow of fluid into the well.

SUMMARY OF THE INVENTION

It is a primary object of this invention to provide an apparatus and method for positioning a self-contained storage unit or dispenser of well chemicals on the bottom of the tubing, and to provide a mechanism for metering out this chemical into solution in the water standing in the well, the rate of dispensing being a function of the rate of flow of fluid into the well.

It is a further object of this invention to provide a means to control the rate of dispensing, dependent, among other factors, on the rate of flow of fluid into the well.

It is a still further object to provide a means for signalling at the surface when the supply of chemical in the dispenser is exhausted.

These and other objects are realized and the limitations of the prior art are overcome in this invention, which provides a reservoir for selected treating chemicals, in the form of solid sticks or chunks. The reservoir or dispenser is in the form of a long cylindrical closed container having one or more openings on the bottom end. This container, or chamber, has means, such as a threaded coupling, for attachment on the bottom end of the tubing string, generally the closed bottom end of the mud anchor.

This chamber is filled with the solid chemical prior to lowering into the well, as the string of tubing is lowered into the well. When the string of tubing is in place, the chamber is, of course, immersed in the liquid standing on bottom. Although the void space in the chamber was filled with air under atmospheric pressure before it was immersed in the bottom fluids, under the small pressure head of liquid in the annulus, some water will be forced into the chamber through the bottom openings, compressing the air.

The metering is provided by the action of the tubing string during the pumping operation. During the upstroke of the rods and plunger, the weight of the column of liquid in the tubing is carried entirely by the rods, and the surface lifting equipment. The tubing just carries its own weight. During the downstroke, this weight load of liquids is transferred from the rods to the tubing, by the closure of the standing valve. This load thrown into the tubing causes it to stretch and lengthen. The amount of lengthening is a function of the length of the string, and the metal cross-section of the tubing, and can be of the order of a foot or more.

So, as the pumping proceeds, the bottom end of the tubing, and the dispensing chamber, rise and fall in synchronism with the pump strokes, sloshing up and down in the well liquid. On each oscillation some water is alternately driven into the chamber, and withdrawn from the chamber, thus substituting water with less chemical in solution flowing in, for water with more chemical in solution flowing out. Also this continual sloshing around tends to mix the water and distribute the chemical in the annulus.

The amount of water (and chemical) transferred is, of course, proportional to the number of strokes, and thus to the total volume of liquid pumped (which is, of course, the same as the volume of liquid flowing into the well).

BRIEF DESCRIPTION OF THE DRAWING

These and other objects and advantages of this invention, and a better understanding of the principles and details of the invention will be evident from the following description, taken in conjunction with the appended drawings, in which.

DESCRIPTION OF THE PREFERRED EMBODIMENT

Figure 1:
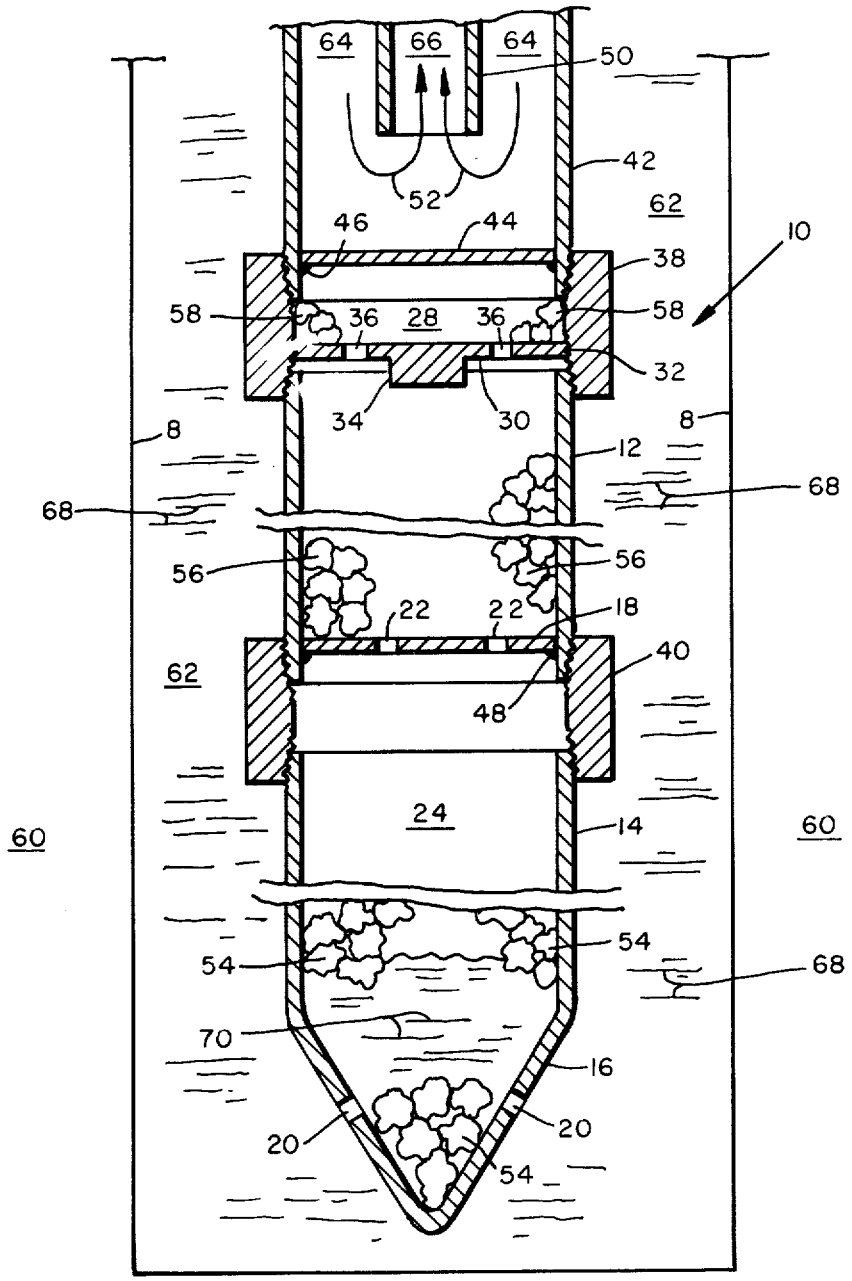
FIG. 1 is a vertical diametral section of one embodiment of the apparatus of this invention.

Referring now to the drawings, there is shown one embodiment of the invention, indicated generally by the numeral 10. It comprises, in general, a long cylindrical container, generally of the same diameter as the well tubing 42. This container is closed at the top, such as by the closure wall 44 at the bottom end of the tubing or mud anchor 42, to which the dispenser 10 can be coupled by means of the coupling 38.

The dispenser comprises at least one length of pipe or tubing such as 12–14, with a pointed bottom end 16 having at least one opening 20 of selected size. As a matter of preferred construction, there would be at least 2 series chambers 12 and 14, with a dividing wall such as 18. There would be at least one opening 22 in the wall 18, corresponding to the openings 20 in the bottom of the lower chamber 14.

The closure wall 44 of the mud anchor 42 forms the top of the upper chamber 12, while the wall 18 with its at least one opening 22 forms the open bottom of the top chamber. The pointed bottom closure 16 of the lower chamber 14 forms the open bottom of the second chamber.

While I have illustrated the invention by means of an apparatus having two serial chambers 12, 14 having a separating wall 18 with at least one opening therein, the device illustrated could work just as well without the wall 18, as a single chamber, or with more than two chambers, such as 5, or 10.

The choice of how long the overall length should be, or the number of separate chambers, depends on the total amount of chemical to be stored and dispensed. As an example, if the length of the dispenser is to be say 15–20 feet, it would be wise to provide say 4 or 5 chambers. The basis of the choice will be clearer after a description of the process involved.

Consider one chamber 12, 14, 16 without wall 18, closed at the top by 44, and open on the bottom 20, 20. This chamber is filled with sticks or chunks of solid chemical 54, 56 of selected chemical nature, such as is well known in the art. This chemical must be soluble in the water that is produced along with the oil, from the pores of the producing formation 60, which forms the wall 8 of the well. The annulus of the well, space 62, is filled with produced fluid from the formation 60. This will generally be oil plus water, in varying proportions. It is the water which is the cause of the condition that requires the chemical treatment. The water carries chemicals, which in the annulus, under lower pressure precipitate out of solution, plating, and adhering to the wall of the well, and in the pores of the rock.

The object of providing the dispenser is to dispense, or meter, the chemical, at a selected rate over a selected short or long period. It is important that the period be not too short, since to replace an empty dispenser 10 with a full one, requires a pulling rig and the pulling of rods and tubing. Then another container 10 can be screwed onto the bottom end of the tubing string and the string of tubing and rods again lowered into the well.

METHOD OF OPERATION

The normal manner of pumping wells of nominal depth and small or medium fluid flows, is to provide a plunger pump in the bottom of the tubing, operated by a string of sucker rods reaching to the surface, with normal surface lifting equipment which will be fully described in connection with FIG. 3. The method of pumping is old and well known and requires no description.

It is clear from the normal method of pumping that during the lifting stroke of the sucker rods the full weight of the column of liquid in the tubing is carried by the travelling valve, the plunger, and the sucker rods. During the second half of the cycle when the rods and plunger are moving down, the traveling valve is open and the weight of the column of liquid is carried by the closed standing valve, and the tubing. This weight suddenly applied to the tubing, in addition to its own weight, causes an elongation of the tubing, and a corresponding shortening, when the weight is again transferred to the rods, once each pump cycle. Thus there is a continuing bobbing up and down of the bottom of the tubing, in symchronism with the pump cycles. This elongation can be readily calculated knowing the wall thickness and size of the tubing, and its length. It is reported to be in the range of 12"–18" or more, and of course, increases with increased length of tubing When the dispensing chamber of this invention is attached to the bottom of the tubing, and the string of tubing lowered into the well, the small pressure head of the well fluid in the annulus will cause some fluid to move into the chamber, through the bottom openings. This fluid will generally comprise oil and water, or simply water.

Then as the pump is operated, and the bottom end of the tubing string oscillates up and down, and the chamber with it, additional water will be pushed into and withdrawn cyclically from the chamber through the bottom openings. The sloshing of the water inside of the chamber will mix new water with old. Thus, there will be a continual withdrawal of water saturated with chemical, and replacement with water without chemical.

In this way there will be a continuous removal of chemical from inside the chamber to the water standing in the base of the well. Since this water is in contact with the walls of the well, the chemical in the water can act on the surface, and to a small extent on the pores, of the formation.

By increasing the number of openings in the bottom, the in and out sloshing of water flow will increase, with a corresponding increase in rate of dispensing of chemical. On the other hand, increase in length, and number of chambers, will reduce the rate of dispensing.

The chemical should be solid, in the form of sticks or chunks. The holes in the dividing walls and bottom should not be too small so as not to stop up with dirt, etc. Openings $\frac{1}{8}$ to $\frac{1}{4}$ inch diameter are satisfactory.

The transverse closure walls can be welded in place such as the welds 46 and 48 for the discs 44 and 18. The openings 22 can be separate openings, preferably $\frac{1}{4}$ inch diameter or a groove, $\frac{1}{4}$ inch wide (not shown).

Another type of transverse wall is a cast circular disc 30 with appropriate pipe threads on the rim, so that the disc can be screwed into a pipe coupling 38, and tightened by means of a cast square hub 34. These are available on the market and are known as "Skinner discs".

A skinner disc 30 with openings 36 is shown closing off a small chamber 28, entirely within the coupling 38, and closed on the top by the wall 44 of the mud anchor 42. This small volume 28 can be used to hold granules of a water soluble dye material 58. The purpose is to indicate at the surface in the pump output that the dispenser is depleted of chemical.

Figure 3:
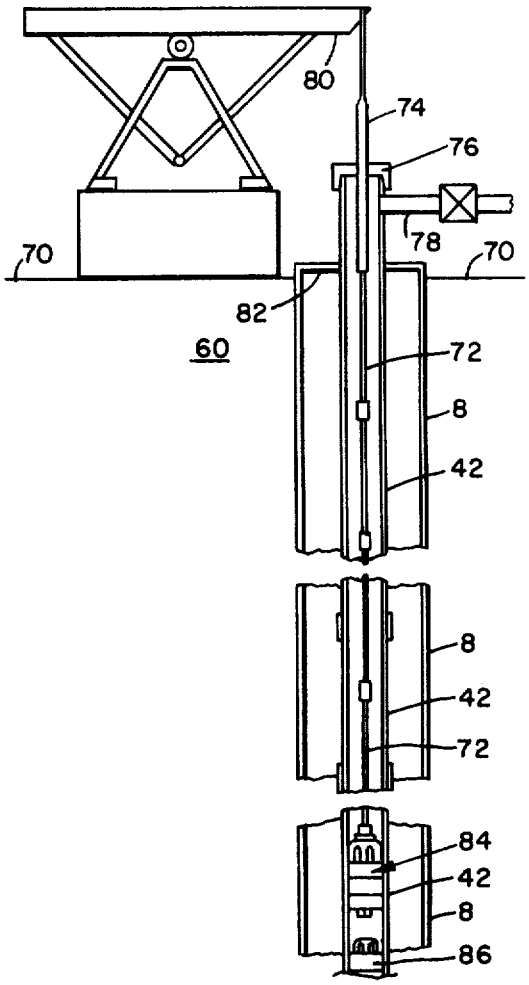
FIG. 3 ( PRIOR ART )
FIG. 3 is a prior art drawing of conventional well pumping apparatus.

On the top of the mud anchor is usually positioned a perforated nipple (see FIG. 3) and above that the usual coupling with standing valve (see FIG. 3). The inlet pipe 50, of which the bottom end is shown, hangs from the bottom of the standing valve and provides the inlet to the pump. Well fluids entering the pump pass in through the perforations of the perforated nipples and flow down the annulus 64 between the inlet pipe 50 and the mud anchor wall 42, and, in accordance with arrows 52, up through the internal passage 66 in the inlet pipe 50 to the standing valve, etc.

The treating chemical can be of any selected material, and its character forms no part of this invention. It is shown as chunks 54, in the space 24, and as 56 in the space 26. They can be the same material, or different, in each of the chambers 14 and 12.

While I have shown the preferred embodiment of this invention with a pointed end or bottom, it would be equally possible to operate with a transverse closure on the bottom, with appropriate openings. For example, the bottom end of chamber 14 could be constructed exactly like the bottom of the chamber 12, that is, with a transverse wall 18 welded 48 in place, and with appropriate openings 22.

Figure 2:
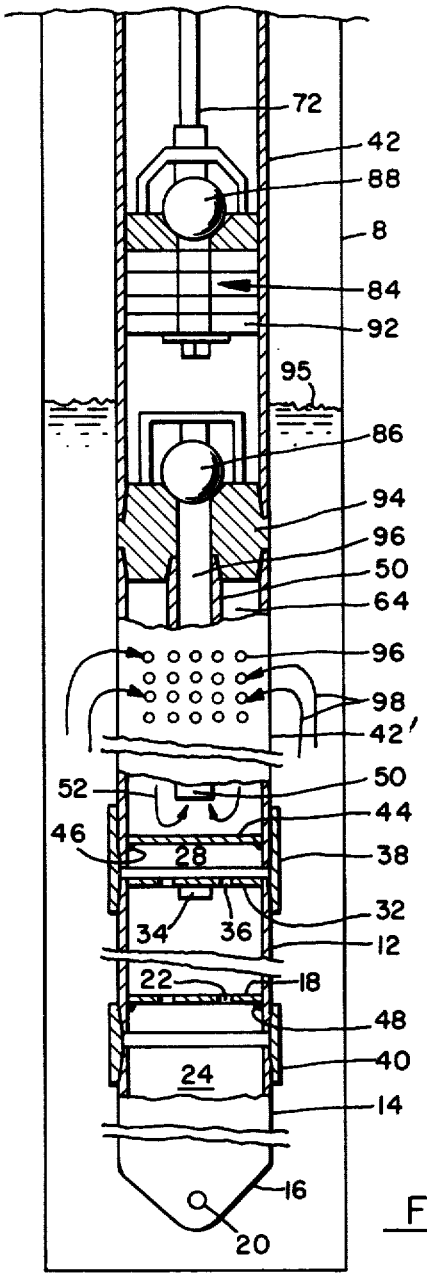
FIG. 2 is an enlarged view of the bottom part of FIG. 3, and including a reduced size view of FIG. 1.

Referring now to FIGS. 2 and 3, there is shown an example of prior art apparatus for pumping oil wells. This is based on FIG. 1 of U.S. Pat. No. 2,300,348 issued to F. E. Dana, Apr. 21, 1941, and is conventional in all respects.

The well and pumping system comprise a well bore 8 in the earth 60 from the surface 70 to a selected depth. The borehole may be cased, as shown, or may be an open hole, as shown in FIGS. 1 and 2. The casing 8 has a conventional top closure 82 that supports a string of tubing 42 that is anchored to, and supported by, the casing closure 82, and reaches almost to the bottom of the well.

The "string of tubing" is composed of lengths of threaded pipe, of a selected diameter, such as 2", for example, reaching from the surface to a point near the bottom of the well. Each length is a "piece of tubing". The "string of tubing" is the assembly of multiple lengths of tubing 42, connected by conventional pipe collars. Near the bottom end of the tubing string is a standing valve 86. This is a check valve (see FIG. 2) that permits inflow of liquid to the bottom of the tubing string 42, and supports the column of liquid in the string of tubing as the pumping proceeds, and as the tubing string is filled to the surface with pumped liquid.

To pump liquid from the well, a string of sucker rods 72, which are long threaded steel rods, with are joined to each other by threads, to stretch from the top of the well to a point just above the standing valve 86. The top part of the string of sucker rods has a polished cylinrical rod 74 sealed through a gland 76, and is attached to a rocker arm 80 which is motor driven (not shown) to reciprocate the upper ends of the sucker rod string through a selected distance of travel. The pipe 78 leads from the top of the tubing to the field oil tank, etc.

Attached to the bottom end of the sucker rod string is a sucker rod pump plunger 84, which has a traveling check valve 88, FIG. 2. The valve comprises a spherical ball 88 in a valve seat in the body of the plunger, or sucker rod piston. A plurality of seal rings 92 slide in the polished inside surface of the lower portion of the tubing, called the pump barrel.

FIG. 2 shows, to an enlarged scale, the lower part of the tubing string 42, and, to a reduced scale, the apparatus of this invention attached to the bottom end 42' of the tubing string. Transverse plate 44 is welded to the bottom end 42' of the tubing string. The dispenser 10 of FIG. 1 is attached to the threads of the bottom end of the tubing 42' by means of collar 38, as shown in FIG. 1.

In FIG. 2 the standing valve 86 is a spherical ball which seals against the seat in a body 94 which is attached by threads to the tubing string 42 a short distance above the closure plate 44. A short length of tubing 42', often called a mud anchor, is attached below the standing valve body 94. The bottom of the body 94 has a small diameter pipe 50, generally called a gas anchor, extending down into the mud anchor to just above the plate 44. Near the top of the mud anchor 42', or lowest part of the tubing string, are a plurality of holes 96, generally called a perforated nipple. Well liquid flows through the perforations 96 into the mud anchor, in accordance with arrows 98, and down inside the annular space 64 between the pipe or gas anchor 50 and the tubing 42' in accordance with arrows 52, and up through the gas anchor 50, and through the standing valve 86 into the space above the standing valve and below the plunger 84.

The level 95 of the liquid standing in the well annulus in the bottom of a well must be above the standing valve 86, so that when the plunger 84 is lifted by the sucker rods, liquid will be drawn, under the pressure head of 95, through the openings 96 into the mud anchor 42', down 52, and up through the gas anchor, through valve 86 and into the tubing.

When the sucker rods are lowered, the liquid standing above 86 moves up through valve 88 to the space above the plunger 84. Then on the next lift of the plunger, the liquid above the plunger moves up, and new liquid from the annulus takes its place above the standing valve, etc.

As previously described, this process of reciprocating the sucker rods to produce liquid from the well causes the bottom end of the tubing string 42 to reciprocate up and down through a selected distance, and with it the dispenser 10. This vertical reciprocation of the dispenser causes well liquid to flow into and out of the container through the bottom openings 20, and so on.

While this invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In an oil well, including at least a conventional string of tubing, a string of sucker rods, a sucker rod pump including a traveling valve; and a standing valve; an apparatus for dispensing well treating chemicals over a selected period of time, while said sucker rod pump is pumping fluid from said well, said apparatus comprising;

(a) a closed cylindrical container having at least one chamber of selected diameter and of selected length; and means to removably rigidly attach said container to the bottom of said string of tubing, below the inlet of said sucker rod pump;

(b) at least one opening of selected size in the bottom end of said container;

(c) said container is at least partially filled with at least one piece of solid well treating chemical of selected chemical composition and attached to the the bottom of said tubing string; and (d) means to reciprocate said container vertically through a selected distance, while said container is immersed in the well fluid standing in the bottom of said well;

whereby when said dispense is submerged in the well fluids in the bottom of said well; and when said sucker rod pump is operated, the bottom end of said tubing string and said dispenser will be vertically reciprocted through a selected distance; and well liquids will be alternately forced into, and withdrawn from, said container through said bottom opening, carrying said chemical into solution in the water standing in the bottom of said well.

2. The apparatus as in claim 1, including at least one transverse wall in said container, intermediate between the top and bottom, and including at least one opening of selected size in said transverse wall;

whereby said container comprises at least two separate chambers, the bottommost chamber having at least one opening in its bottom end, and communicating with the adjacent chamber above, through said at least one opening in said transverse wall.

3. The apparatus as in claim 1 in which said closed cylindrical container includes at least 3 series chambers and two transverse walls each with at least one opening.

4. The apparatus as in claim 3 including a water soluble dye of selected character in the topmost chamber.

5. The apparatus as in claim 3 in which said multiple chambers comprise corresponding lengths of threaded pipe, all joined in series by screw couplings, with an appropriate transverse wall inserted into each of said lengths of pipe, and at least one opening of selected size in each of said transverse walls.

6. The apparatus as in claim 5 in which at least one of said transverse walls comprises a plate welded across one of said threaded pipes.

7. The apparatus as in claim 3 in which at least one of said transverse walls comprises a threaded disc adapted to be screwed into one end of a pipe coupling.

8. The apparatus as in claim 1 in which said at least one opening is at least $\frac{1}{4}$ inch diameter.

9. The apparatus as in claim 1 in which said apparatus includes a pipe coupling at its top end, said pipe coupling adapted to be screwed to the threaded bottom end of said tubing string, the bottom end of which is closed by a transverse wall.

10. The apparatus as in claim 1 in which said container is constructed with a pointed end, with said at least one opening near said pointed end.

* * * * *